US006568359B2

(12) United States Patent
Pischinger et al.

(10) Patent No.: US 6,568,359 B2
(45) Date of Patent: May 27, 2003

(54) PISTON INTERNAL COMBUSTION ENGINE WITH PRESSURE RELIEF GAS EXHAUST VALVES

(75) Inventors: Franz Pischinger, Aachen (DE); Wolfgang Salber, Aachen (DE); Thomas Esch, Aachen (DE); Frank van der Staay, Würselen (DE); Oliver Lang, Aachen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 10/226,342

(22) Filed: Aug. 23, 2002

(65) Prior Publication Data

US 2003/0041822 A1 Mar. 6, 2003

(30) Foreign Application Priority Data

Aug. 23, 2001 (DE) ..... 101 41 431

(51) Int. Cl.[7] ..... F01L 9/04
(52) U.S. Cl. ..... 123/90.11; 60/324
(58) Field of Search ..... 60/272, 273, 322–324; 123/90.11–90.13, 590, 672, 676, 679, 681, 90.23

(56) References Cited

U.S. PATENT DOCUMENTS 4,051,821 A * 10/1977 Amann ..... 123/393
5,079,921 A * 1/1992 McCandless et al. ..... 60/602
6,109,027 A * 8/2000 Schaefer ..... 60/324
6,269,806 B1 * 8/2001 Dellarosa ..... 123/590

* cited by examiner

*Primary Examiner*—Thomas Denion
*Assistant Examiner*—Kyle Riddle
(74) *Attorney, Agent, or Firm*—Venable; Norman N. Kunitz

(57) ABSTRACT

A piston internal combustion engine with at least one gas exhaust valve (2) for each cylinder (1), which is actuated by an actuator (7), in particular an electromagnetic actuator, controlled by a fully variable engine control unit (15). Based on the predetermined operating cycle, the valve can close off the cylinder interior space against a gas exhaust channel (13) that follows the valve seat (3) of the exhaust valve. This channel is connected to an exhaust gas system and is provided with a means for example a constriction (14) for reducing the pressure gradient during the start of the opening of the gas exhaust valve (2). A specific pressure fluctuation is used for a further reduction in the pressure gradient behind the exhaust valves during the opening through a corresponding layout of the pipe geometry and the container volumes in the exhaust gas system or corresponding installed components.

12 Claims, 3 Drawing Sheets

PISTON INTERNAL COMBUSTION ENGINE WITH PRESSURE RELIEF GAS EXHAUST VALVES

CROSS-REFERENCE TO RELATED APPLICATION

This application is based on and claims the priority date of German Application No. 101 41 431.5, filed on Aug. 23, 2001, which is incorporated herein by reference.

BACKGROUND OF THE INVENTION

To avoid load changing losses with a high cylinder load, the gas exhaust valves on piston internal combustion engines must open prior to the end of the expansion cycle, at a point in time when the pressure inside the cylinder still registers values of several bars. The valve actuation force in that case not only must overcome the valve spring counter-acting force and the inertial force, but also the gas pressure force on the cylinder interior that acts upon the valve disk or poppet assembly of the gas exhaust valve.

With gas cylinder valves actuated by camshafts, the additionally required force is generated without problem via the camshaft drive.

However, with piston internal combustion engines provided with gas cylinder valves that are actuated with the aid of fully variably controlled actuators, in particular electromagnetic actuators, the relatively high cylinder interior pressure still present at the start of the opening has a negative effect. This effect is noticed in the higher actuation force that must be generated to open the exhaust valve. The higher force requirement can be met, for example, by providing a stiffer valve opening spring in the actuator, so that the valve opening spring is correspondingly pre-tensioned during the valve closing with the aid of a higher magnetic force and thus a higher electrical energy at the closing magnet.

SUMMARY OF THE INVENTION

It is the object of the invention to support the opening of a gas exhaust valve by influencing the flow conditions in the gas exhaust.

This object is achieved according to the invention with a piston internal combustion engine having at least one gas exhaust valve for each cylinder. The gas exhaust valve is actuated by an actuator, in particular an electromagnetic actuator, which is controlled fully variable by an engine control and can close off the cylinder interior space in accordance with the predetermined operating cycle against a gas exhaust channel that adjoins a valve seat and is connected to an exhaust gas system. The exhaust gas system is provided with means for reducing the pressure gradient between the cylinder interior space and the following gas outlet channel at the start of the gas exhaust valve opening. The advantage of this type of arrangement is that pressure at the constriction or bottleneck already exists at the start of the opening, that is with a small opening cross section at the valve seat, as a result of a specific, periodic pressure build-up in the gas exhaust channel. This pressure is higher than the normal, low counter pressure in the exhaust gas system. The gas force to be overcome by the actuator, which acts from the cylinder interior space upon the gas exhaust valve, is thus reduced short-term at a time when the valve opening spring is still tensioned almost completely. The energy stored in the valve opening spring is therefore sufficient for transferring the valve to the location for capturing the armature of the opening magnet. Subsequently, the gas exhaust valve can be opened fully and practically without increased energy expenditure.

For one embodiment of the invention, the constriction functions as a means for reducing the pressure gradient in the gas exhaust channel.

One advantageous embodiment of the invention provides that the constriction is arranged near the valve seat. The volume delimited by the valve seat on the one hand and the constriction on the other hand can thus be kept as small as possible. The desired pressure therefore builds up quickly and the pressure difference between the pressure on the inside of the cylinder and the pressure in the adjacent exhaust gas system is reduced correspondingly quickly.

Another advantageous embodiment of the invention provides that in the region following the constriction in a flow direction of the exhaust gases, the open flow cross section expands in the manner of a diffuser, at least over a partial length of the gas exhaust channel. As a result, the exhaust gas that is pushed by the piston out of the cylinder chamber can flow off quickly and without problems during the course of the further opening of the gas exhaust valve.

With an arrangement of two gas exhaust valves for each cylinder, it is particularly advantageous if the two gas outlet or exhaust channels converge into a single channel, wherein the constriction is arranged in the area of the convergence.

According to a different, advantageous embodiment provided with two gas exhaust valves for each cylinder, one gas exhaust valve is designed to have a constriction and the other gas exhaust valve is designed without a constriction. With a corresponding layout of the engine control in predetermined engine-lcad ranges and utilizing the above-described reduction in the pressure difference, this arrangement allows the gas exhaust valve at the gas exhaust channel provided with a constriction to open ahead of the other gas exhaust valve, particularly in the range of high engine loads. This ensures that the actuator for the other gas exhaust valve, to which a "normal" gas exhaust channel is assigned, practically does not have to overcome any gas force because the high gas force inside the cylinder chamber is already reduced via the gas exhaust valve relieved of pressure due to the build-up of a counter-pressure during the opening operation.

The invention is explained in further detail with the aid of schematic drawings.

DESCRIPTION OF THE PREFERRED EMBODIMENTS

Figure 1:
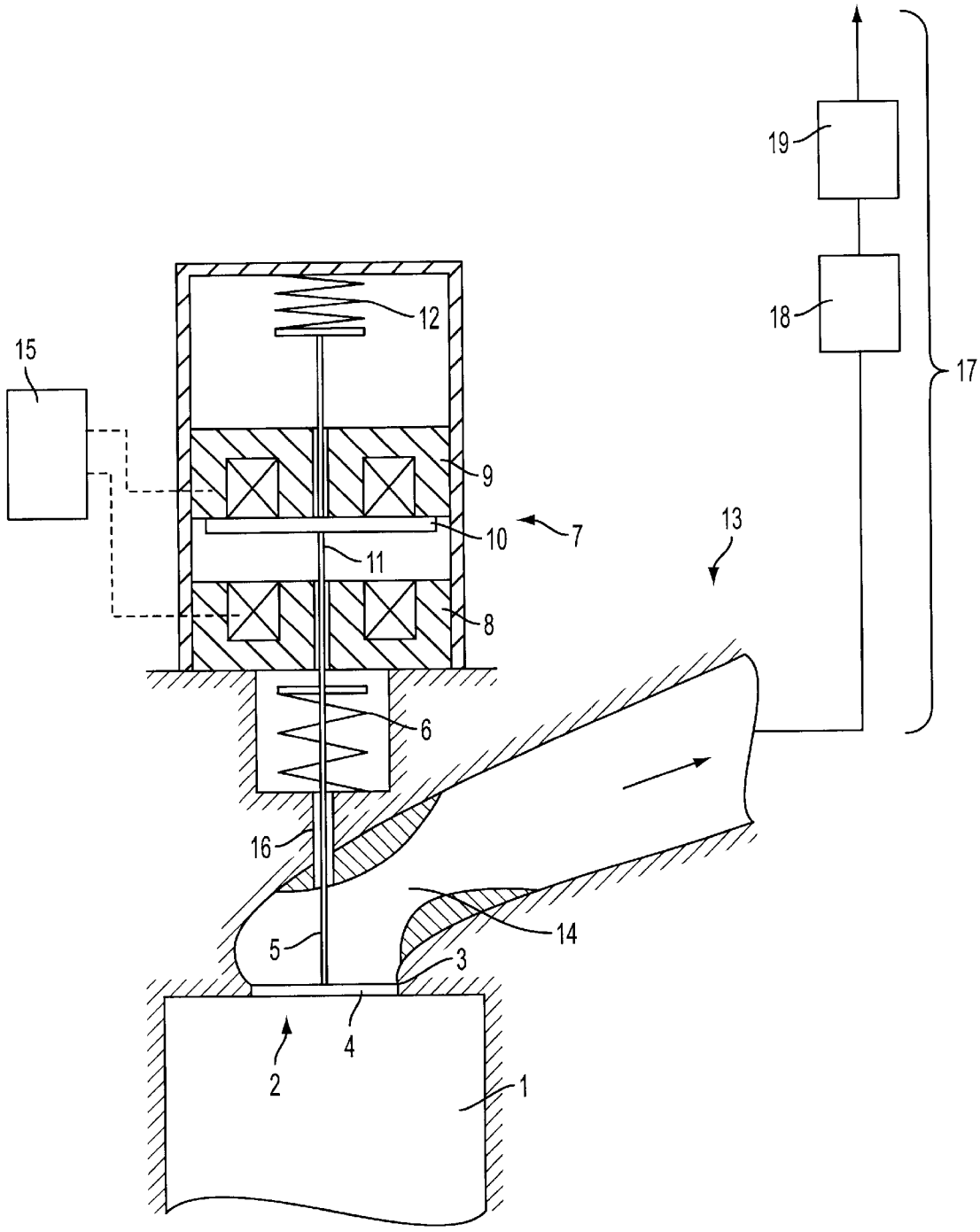
FIG. 1 is a vertical section through the region of a gas exhaust valve.

The gas exhaust region on a cylinder 1 for a piston internal combustion engine, shown only schematically in FIG. 1, essentially consists of a gas exhaust valve 2 that fits flush against a valve seat 3 in the closed position. A valve stem 5 that is connected to the valve disk 4 is acted upon in the closing direction by the force of a closing spring 6.

An electromagnetic actuator 7 is provided for actuating the gas exhaust valve 2. The actuator essentially comprises an opening electromagnet 8, a a closing electromagnet 9, as well as an armature 10 that moves back and forth between the two electromagnets 8 and 9. The armature 10 is provided, for example, with a divided guide rod 11 that extends out of the closing electromagnet 9 and, for the closed position shown herein where the armature 10 rests against the pole face of the closing electromagnet 9, compresses an opening spring 12. Thus, the opening spring 12 moves the armature 10 with the gas exhaust valve 2 into the opening position once the closing electromagnet 9 is no longer supplied with current.

The electromagnetic actuator 7 is connected to an engine control unit 15, not shown in further detail herein, which can alternately supply the closing electromagnet 9 and the opening electromagnet 8 with current, corresponding to the predetermined operating cycle, in known manner. Thus, for the predetermined closing or opening time the armature 10 respectively comes to rest against the pole face of the opening electromagnet 8 or the closing electromagnet 9, corresponding to the predetermined alternating cycle.

The valve seat 3 is followed by a gas exhaust channel or manifold 13 through which the exhaust gas can flow from the cylinder chamber of cylinder 1 and is pushed out by the piston if the gas exhaust valve 2 is opened. The valve stem 5 is guided through outlet channel 13 to the valve disc 4 via a guide 16 in a conventional manner.

Since the gas exhaust valve 2 must open before the end of the expansion cycle or the operating cycle, meaning a gas pressure that is several bars higher than the pressure in the exhaust gas system still exists in the cylinder chamber 1, the gas exhaust valve 2 must open counter to the gas force defined by the area of the valve disk 4 and the gas pressure in the cylinder chamber after the current to the closing electromagnet 9 is cut off via the opening spring 12. As soon as the valve disk 4 lifts off the valve seat 3, the pressure inside the cylinder chamber 1 is reduced during the outflow into the gas exhaust channel 13 to the pressure existing in the subsequent exhaust gas system 17 that is only slightly above the normal atmospheric pressure.

The exemplary embodiment shown in FIG. 1 has a constriction 14 in the area near the valve seat 3 for supporting the opening operation. The cross section of the gas exhaust channel 13 in the region of the constriction 14 advantageously is reduced continuously from a large starting cross section adjacent the valve section 4 to the narrowest cross section. Following the constriction 14, at least a section of the gas exhaust channel is designed as a diffuser through a corresponding cross-sectional expansion or tapering (as shown), so that the exhaust gas can flow out freely.

Once the current to the closing electromagnet 9 is cut off, the constriction 14 allows a corresponding amount of gas to flow out when the valve disk 4 lifts off the valve seat 3 because of the excess pressure in the cylinder 1. However, this gas builds up a pressure in the space between the valve seat 3 and the constriction 14 that is higher than the pressure in the subsequent exhaust gas system 17. As a result, the pressure difference between the pressure space in using of cylinder and this space in front of the constriction 14 is clearly less than the pressure difference between the pressure cylinder interior space and the exhaust gas system 17 if the exhaust gas can flow freely through a gas channel 13 without constriction. The gas force acting upon the valve disk 4 is thus reduced by a corresponding measure, so that the pretensioning force of the opening spring 12 is sufficient to quickly move the gas exhaust valve 2 further in the opening direction, up to the region for capturing by the opening electromagnet 8 that is now supplied with current. This ensures a quick pressure reduction and a fast outflow of the exhaust gases from the cylinder interior space.

The reduction of the gas force at the opening point in time makes it possible to design the opening spring 12 with a correspondingly reduced spring rate, or to reduce the electrical energy that must be generated for the opening operation, or to increase the exhaust valve diameter, or to open the exhaust valve at higher cylinder pressures.

Figure 2:
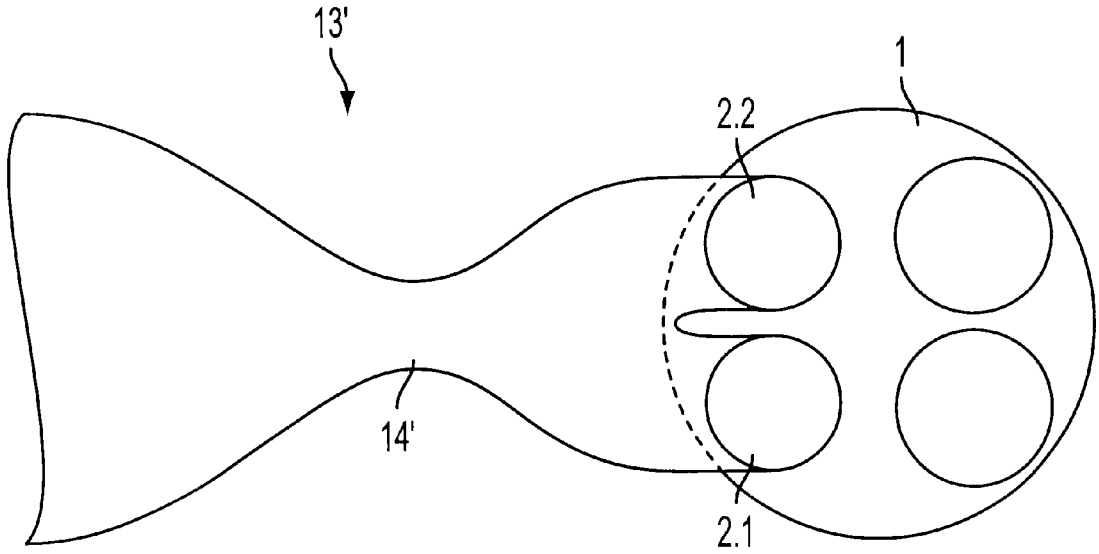
FIG. 2 schematically illustrates the shape of the outlet channel for an embodiment with a cylinder arid two gas exhaust valves.

The exemplary embodiment shown in FIG. 2 has a cylinder 1 provided with two gas exhaust valves 2.1 and 2.2, indicated herein only by the exhaust openings. The gas exhaust channel 13' for this exemplary embodiment is designed as a so-called twin channel. That is, the short channel portions immediately following the individual gas exhaust valves 2.1 and 2.2 converge to form a single channel 13'. The constriction 14' for this embodiment is arranged in the channel-converging or joining region, wherein it must be ensured that the spatial volume between the constriction 14' and the valve seats of both gas exhaust valves 2.1 and 2.2 is as small as possible.

Figure 3:
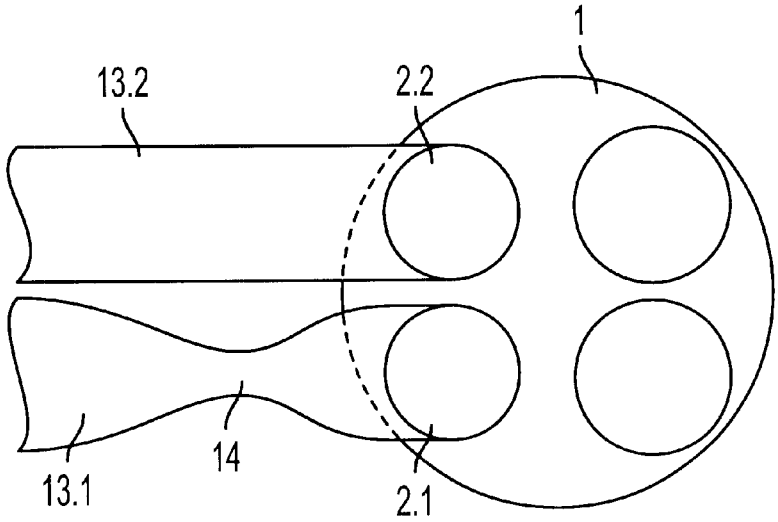
FIG. 3 schematically illustrates a modified version of the embodiment according to FIG. 2, with two separate gas exhaust channels.

FIG. 3 shows an embodiment where the cylinder 1 is also provided with two gas exhaust valves 2.1 and 2.2. For this embodiment, however, each gas exhaust valve is connected to a separate gas exhaust channel 13.1 or 13.2.

The gas exhaust channel 13.1 of this embodiment has a constriction 14 while the exhaust channel 13.2 is designed as "normal" gas exhaust channel.

The electromagnetic actuators for actuating the gas exhaust valves can be actuated fully variable via the engine control 15, as explained in the above, meaning they can be opened and closed at optional times within the prevailing operating cycle or can be kept closed completely. Thus, a piston internal combustion engine with two gas exhaust valves for each cylinder can actuate the two gas exhaust valves at different points in time. For the system according to the invention, it means that the two gas exhaust valves are opened with a slight offset in time. This is advantageous particularly for operating ranges with a high engine load since the higher gas pressure, in particular, means that an increased gas force must be overcome just prior to the opening of the gas exhaust valve.

For the embodiment according to FIG. 2 as well as the embodiment according to FIG. 3, the gas exhaust valve 2.1 is initially opened via the engine control 15, so that a specific pressure can build up in front of the constriction 14, as described in FIG. 1. The gas exhaust valve 2.2 can then be opened with a brief delay, practically without having to overcome a gas force.

Figure 4:
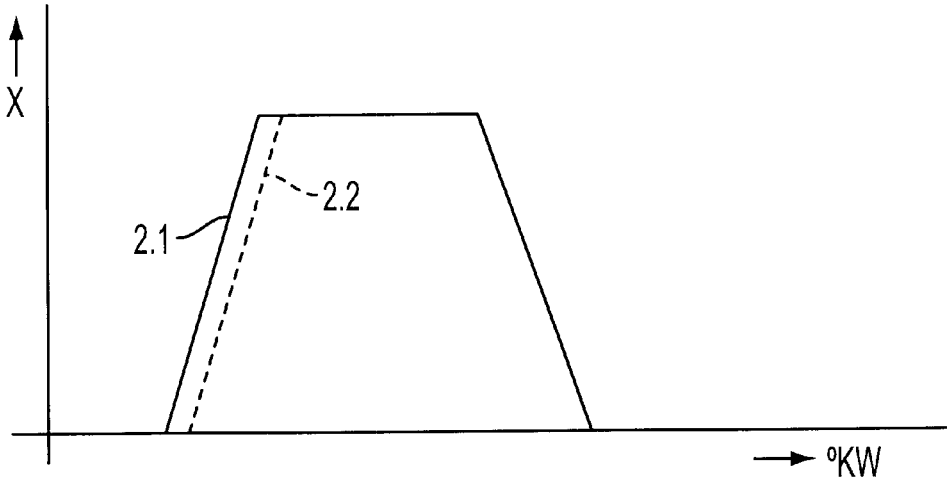
FIG. 4 shows the course of the valve strokes for the embodiment according to FIG. 2 or FIG. 3 in dependence on the crankshaft angle.

This operation is shown in FIG. 4 for the arrangement according to FIG. 2 or FIG. 3. The fully drawn-out curve shows the opening stroke of the gas exhaust valve 2.1 and accordingly is provided with the associated reference number. The dotted curve indicates the opening stroke for the gas exhaust valve 2.2 that opens up to the full valve stroke with a slight crankshaft angle delay after the gas exhaust valve 2.1. However, the closing operation for both valves occurs at the same time.

Figure 5:
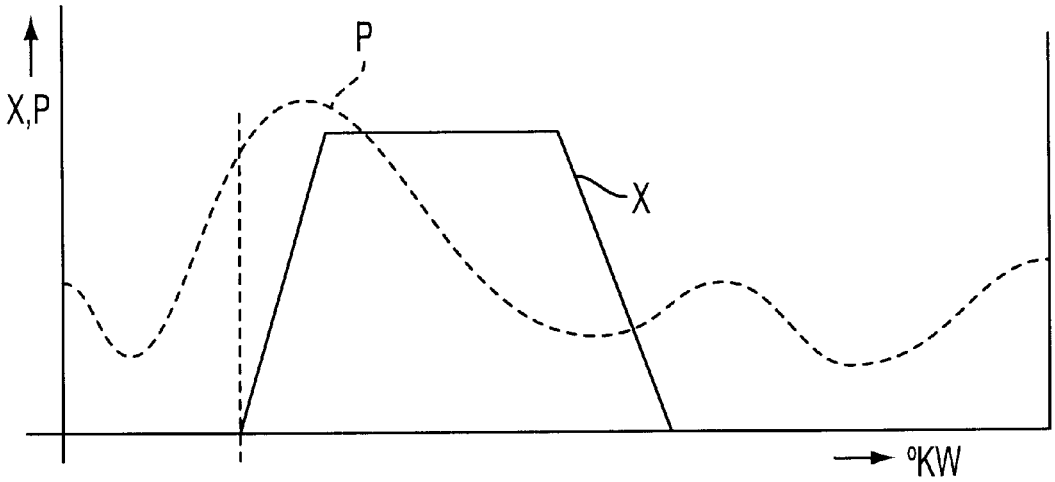
FIG. 5 shows the course of the valve stroke and the course of the pressure in the gas exhaust channel in dependence on the crankshaft angle.

FIG. 5 schematically shows the pressure curve, described with the aid of FIG. 1, in the gas exhaust channel in the region between the valve seat 3 and the constriction 14 in dependence on the crankshaft angle degree relative to the valve stroke. The representation clearly shows that at the time of opening, the pressure in the gas exhaust channel 13 increases noticeably in front of the constriction 14. The pressure level in the exhaust channel at point in time "exhaust opens" can be influenced with a targeted phase position of the pressure fluctuations in the exhaust gas system.

The invention furthermore suggests designing the subsequent exhaust gas system 17 with a specific layout lengthwise of the pipe geometry and the container volumes (catalytic converter 18, muffler 19) and/or installing components behind the gas exhaust valve and/or behind the constriction 14. Thus, the pressure wave play generated by the discharge push of the same cylinder or of a different cylinder is reflected and runs up against the gas exhaust valve that opens up or against the constriction on the exhaust side with a pressure phase that is higher than the pressure level, meaning a "pressure hill." As a result, it causes an even faster pressure build-up on the outside, in front of the valve seat, or in the space between valve seat 3 and the constriction 14 by the gases flowing from the cylinder chamber in the opposite direction.

The installed components can be controllable valves or the like, arranged either in front of or at the intake for a catalytic converter 18 or a sound damper 19. For a design with two gas exhaust valves, for example the embodiment shown in FIG. 3, a component of this type can respectively be installed at the location where the two gas exhaust channels 13.1 and 13.2 converge. The layout of the exhaust gas system, including the targeted pressure increase at the opening time with a pressure wave play advantageously occurs at "critically" high speeds. That is to say, at speeds where the electromagnetic actuator can no longer move the gas exhaust valve at the precise time to its closing position, if the gas exhaust valve was previously opened with a delay by the actuator as a result of high pressure inside the cylinder.

The pressure wave level, which is essentially based on resonance phenomena in the exhaust gas system, can be utilized with or without a constriction.

The invention now being fully described, it will be apparent to one of ordinary skill in the art that many changes and modifications can be made thereto without departing from the spirit or scope of the invention as set forth herein.

What is claimed is:

1. A piston internal combustion engine, including:

at least one gas exhaust valve for each cylinder;

an electromagnetic actuator connected to the exhaust valve and fully variably controlled by an engine control unit to close off the cylinder interior space in accordance with the predetermined operating cycle against a gas exhaust channel that has one end connected to and following a valve seat of the exhaust valve;

an exhaust gas system connected to the other end of the gas exhaust channel;

means disposed in the gas exhaust channel for reducing the pressure gradient between cylinder interior space and the adjoining gas exhaust channel at the start of the opening of the gas exhaust valve.

2. A piston internal combustion engine according to claim 1, wherein the means for reducing the pressure gradient in the gas exhaust channel is a constriction disposed in the gas exhaust channel.

3. A piston internal combustion engine according to claim 2, wherein the constriction is arranged in the area of the gas exhaust channel adjacent the valve seat.

4. A piston internal combustion engine according to claim 2, wherein the constriction is disposed at a short distance from the valve seat.

5. A piston internal combustion engine according to claim 2, wherein the cross section of the gas exhaust channel cross section in the region of the constriction is reduced continuously from a starting cross section to the smallest cross section of the constriction.

6. A piston internal combustion engine according to claim 2, wherein the open flow cross section in a flow direction of the exhaust gases expands in the manner of a diffuser over a portion of the gas exhaust channel following constriction.

7. A piston internal combustion engine according to claim 2, wherein the valve stem is disposed in a guide and extends through the gas exhaust channel to the valve seat and the constriction is arranged approximately in the region directly behind the valve stem guide.

8. A piston internal combustion engine according to claim 2, wherein: the engine has two gas exhaust valves for each cylinder; each exhaust valve has a respective gas exhaust which converge to form a single outlet channel for connection to the gas exhaust system; and the constriction is arranged in the region of joining of the two gas exhaust channels.

9. A piston internal combustion engine according to claim 2, wherein: the engine has two gas exhaust valves for each cylinder; a respective gas exhaust channel is provided for each gas exhaust valve; one gas exhaust channel is provided with the constriction; and the other gas exhaust channel is designed without a constriction.

10. A piston internal combustion engine according to claim 1, wherein the engine has two gas exhaust valves for each cylinder, and the engine control unit, for predetermined engine load ranges, causes one gas exhaust valve to open ahead of the other gas exhaust valve.

11. A piston internal combustion engine according to claim 10 wherein the predetermined engine ranges are high engine load range.

12. A piston internal combustion engine according to claim 1 wherein the exhaust gas system has pipe lengths, container volumes and any installed necessary components, such that a reflected pressure fluctuation at the initial opening time runs up against at least one of the gas exhaust valve and the constriction with a pressure peak.

* * * * *